US012497878B2

(12) United States Patent
Imel et al.

(10) Patent No.: US 12,497,878 B2
(45) Date of Patent: Dec. 16, 2025

(54) ELECTRICALLY POWERED PUMPING UNIT WITH REMOVABLE PUMP MODULES

(71) Applicant: Halliburton Energy Services, Inc., Houston, TX (US)

(72) Inventors: John Leslie Imel, Duncan, OK (US); Glenn Howard Weightman, Duncan, OK (US); Jeff Nickles, Duncan, OK (US); Bruce Carl Lucas, Duncan, OK (US); Timothy Holiman Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 7 days.

(21) Appl. No.: 18/136,453

(22) Filed: Apr. 19, 2023

(65) Prior Publication Data

US 2024/0352841 A1 Oct. 24, 2024

(51) Int. Cl.

| | |
|---|---|
| ***E21B 43/26*** | (2006.01) |
| ***F04B 17/03*** | (2006.01) |
| ***F04B 17/06*** | (2006.01) |
| ***F04B 23/04*** | (2006.01) |

(52) U.S. Cl.

CPC ..... *E21B 43/2607* (2020.05); *F04B 17/03* (2013.01); *F04B 17/06* (2013.01); *F04B 23/04* (2013.01)

(58) Field of Classification Search

CPC ..... E21B 43/2607; E21B 43/04; E21B 17/03; E21B 17/06

USPC ..... 166/85.1

See application file for complete search history.

(56) References Cited

U.S. PATENT DOCUMENTS

| | | | | |
|---|---|---|---|---|
| 9,395,049 | B2 | 7/2016 | Vicknair et al. | |
| 10,914,155 | B2 | 2/2021 | Oehring et al. | |
| 10,954,770 | B1 * | 3/2021 | Yeung | E21B 47/008 |
| 11,015,423 | B1 | 5/2021 | Yeung et al. | |
| 11,085,281 | B1 | 8/2021 | Yeung et al. | |
| 11,168,554 | B2 * | 11/2021 | Morris | F04B 17/06 |
| 11,261,717 | B2 | 3/2022 | Yeung et al. | |
| 11,339,638 | B1 | 5/2022 | Yeung et al. | |
| 11,512,570 | B2 | 11/2022 | Yeung et al. | |
| 2020/0040878 | A1 | 2/2020 | Morris | |
| 2021/0381358 | A1 | 12/2021 | Yeung et al. | |

(Continued)

FOREIGN PATENT DOCUMENTS

| | | | |
|---|---|---|---|
| CA | 3114012 | A1 | 12/2021 |
| WO | 2018044307 | A1 | 3/2018 |

OTHER PUBLICATIONS

First Office Action, Saudi Arabia Appl. No. 123450551 for patent entitled "Electrically Powered Pumping Unit With Removable Pump Modules", dated May 5, 2024, 6 pages.

(Continued)

*Primary Examiner* — Tara Schimpf
*Assistant Examiner* — Patrick F Lambe
(74) *Attorney, Agent, or Firm* — Conley Rose, P.C.; Rodney B. Carroll

(57) ABSTRACT

A modularized, electric pumping unit comprising: a base structure; an electric motor mounted on the base structure; and one or more pump modules. Each of the one or more pump modules comprises a pump and a pump module structure. The one or more pump modules are configured to be removably mounted on the base structure and driven by the electric motor.

22 Claims, 11 Drawing Sheets

(56) References Cited

U.S. PATENT DOCUMENTS

| | | | | |
|---|---|---|---|---|
| 2023/0041566 | A1 | 2/2023 | Yeung et al. | |
| 2024/0247646 | A1 * | 7/2024 | Morris | F04B 17/03 |

OTHER PUBLICATIONS

Foreign Communication from Related Application—Examiner's Report regarding Canadian Application No. 3,199,217, dated Oct. 28, 2024, 9 pages.

* cited by examiner

ELECTRICALLY POWERED PUMPING UNIT WITH REMOVABLE PUMP MODULES

FIELD

This disclosure relate generally to the field of pumping. More particularly, this disclosure relates to the field of pumping units comprising an electric motor. Still more particularly, this disclosure relates to modularized, electric pumping units comprising one or more pump modules.

BACKGROUND

Conventional pumping units, such as those utilized for wellbore operations (e.g., for hydraulic fracking) are not modularized. Accordingly, complete pumping units are generally maintained as back-ups, replacing a pump can be a time-consuming operation, and transportation of such a pumping unit can be a challenge, for example, due to weight restrictions.

BRIEF DESCRIPTION OF THE DRAWINGS

Embodiments of the disclosure may be better understood by referencing the accompanying drawings.

DESCRIPTION

Figure 1A:
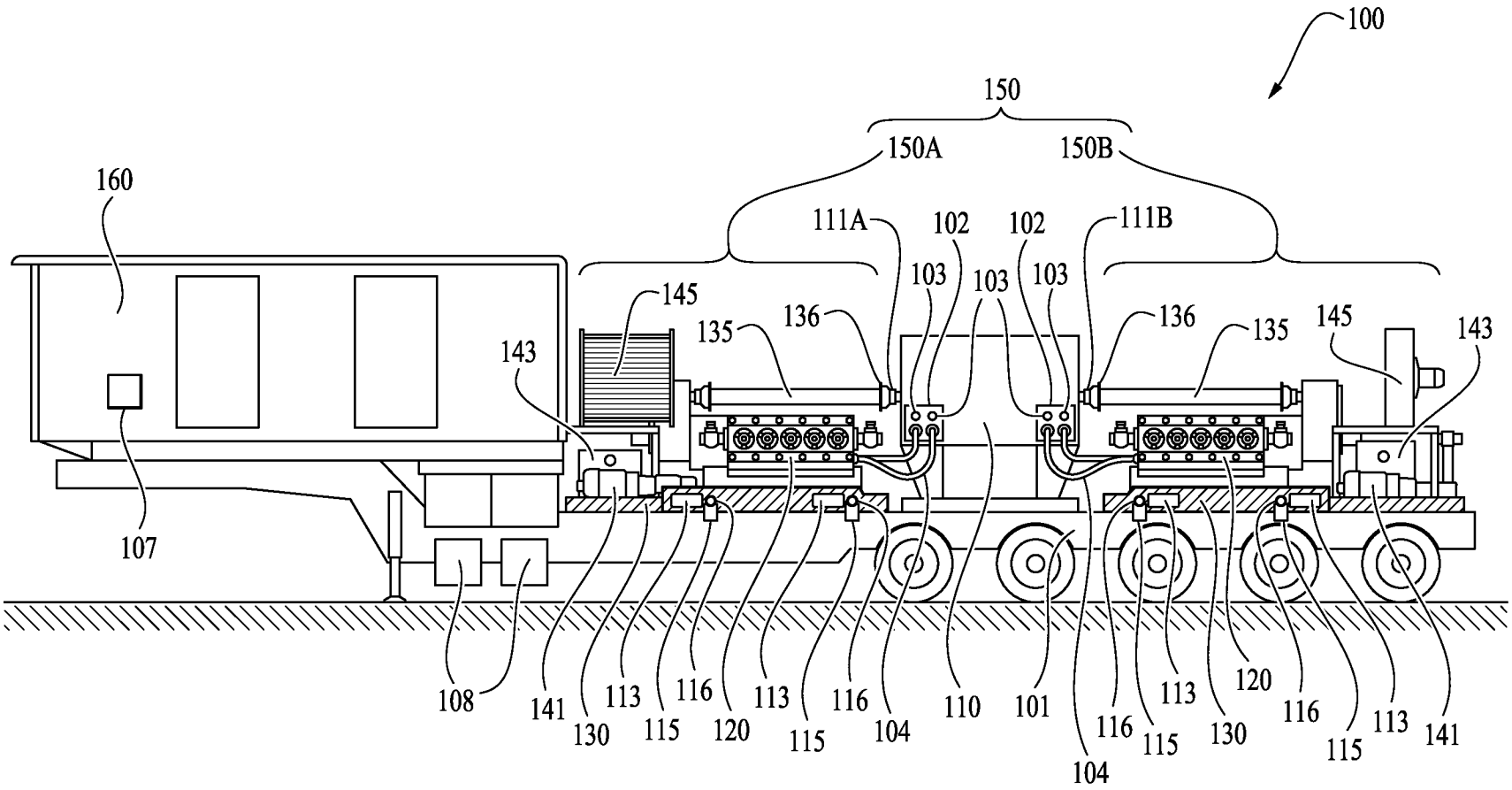
FIG. 1A is a schematic of a modularized, electric pumping unit, according to embodiments of this disclosure.

The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description.

As noted hereinabove, conventional (e.g., electric) pumping units are not modularized. Accordingly, complete pumping units are generally maintained as back-ups, and replacing a pump can be a time-consuming endeavor. Furthermore, the weight of such conventional pumping units can make transportation to some locations of use difficult. The self-contained pump modules, as disclosed herein, can enable back-up equipment to comprise primarily pump modules themselves, and not the entire pumping unit, thus enabling faster pump replacement. Furthermore, as noted above, conventional pumping unit designs are typically too heavy to transport into certain areas. The modular pumping unit design of this disclosure can enable weight removal (e.g., via removal of one or more pump modules from a pumping unit) for transport, as detailed further hereinbelow.

Herein disclosed is an electrically powered pumping unit with removable pump modules. The pumping unit comprises a base structure onto which can be mounted: an electric motor, an electric motor drive assembly, a control assembly, auxiliary electric power supply, at least one pump module, connection points for fluid hoses and electrical cables from the pump module(s), or a combination thereof. Via this disclosure, auxiliary systems can be included as part of the pump module(s) rather than being attached to the base structure.

The base structure is not particularly limited, and can be, for example, a truck, a trailer, or a skid. A receptacle for receiving electrical power can be mounted on the base structure (for example, as a component/connector of a connectors panel as described hereinbelow). Connectors from which to serve fluids, electrical power, controls to the pump module(s), and/or to receive sensor feedback from the pump module(s) can also be mounted on the base structure (e.g., on the connectors panel). The electric motor, the electric motor drive, and/or auxiliary electric power supply can be mounted as part of a base structure assembly. A pump packing lubrication system can also be mounted on the base structure. The base structure can further comprise mounting point(s) or elements to receive complementary mating points/elements from each of the pump modules to properly position and align the pump module relative to the electric motor.

As detailed further hereinbelow with reference to the figures, the pump module comprises: a pump module structure, a pump, a driveline, and pump auxiliary systems. The pump module(s) are removable from the base structure. Removing one or more pump modules from the pumping unit can reduce a weight of the pumping unit for transportation, and to enable more efficient maintenance. The pump module(s) comprise cables and/or hoses that extend to the connectors mounted on the base structure.

In addition to the mounting points to attach the pump module to the base structure, the pump module structure can also comprise lifting components/points for use in lifting/removing the pump module from the base structure. Lifting provisions can be, for example, forklift pockets, lifting eyes, or other lifting means. The pump module structure can be configured to attach to the mounting points to the base structure in such a manner as to assure proper positioning and alignment of the driveline with respect to a motor shaft of the electric motor on the base structure. As described further hereinbelow, the pump module structure may also include guards, guarding, armor, or other physical barriers isolating and preventing access or contact with rotating or otherwise moving components (e.g., driveline) during operation of the pumping module (e.g., isolation or barrier structure designed to prohibit personnel from entering an area having moving parts, e.g., a "red zone," during operation of the pumping equipment for safety purposes). As described further hereinbelow, the pump module structure may also include deflectors, trays, tanks, drip pans, catch basins, absorbent trays, absorbent pads, and the like, such as for directing or containing fluids.

The pump auxiliary systems can include an oil lubrication pump powered by an electric motor, an oil reservoir, an oil filter, an oil cooler (e.g., comprising a heat exchanger having an electric motor-driven fan), an oil heater (e.g., comprising a heat exchanger or heating element such as an electrical resistance heating element disposed within the oil reservoir or a heating jacket disposed around all or a portion of the oil reservoir), a sensor package (e.g., including sensors for pressure, temperature, position, performance monitoring, etc.), and/or a driveshaft assembly. The pump auxiliary systems can also include suction and discharge manifolds with connections for piping, a pressure relief valve (e.g., fluidically couple to a high pressure outlet of the pump to provide pressure relief in the event of an overpressure condition in the outlet high pressure manifold or piping downstream from the pump (e.g., a blockage or restriction), a pump packing lubrication system, driveshaft clutch and/or driveshaft decoupler, electrical cables, and/or controls systems as part of the pump module.

In embodiments, the electric motor comprises a shaft protruding from two sides/ends thereof to drive two pumps, and the base structure is configured to accommodate two pump modules driven by the single electric motor.

As noted herein, the pumping unit of this disclosure can facilitate transporting of the modular, electric pumping unit. Transporting can comprise removing at least one pump module from the pumping unit prior to transport. The base structure and the pump module(s) can be transported separately, if desired. Once delivered to location, the pumping unit can be assembled by reinstalling the pump module(s).

Pump module removal can include disconnecting the driveline from the electric motor, unplugging electrical cables and/or hoses from the connections (e.g., connector panel) on the base structure, releasing pump module mounting points, lifting the pump module via lifting components/points of the pump module structure, and removing the pump module from the base structure. The aforementioned steps can be taken in reverse for installation of each pump module.

Although not so limited, in embodiments, the pump of each pump module can be a triplex or quintuplex plunger pump. As detailed further hereinbelow, the pump of each pump module can be mounted to the pump module structure of the pump module in a manner that accommodates flexure of the pump module structure. For example, in embodiments, a three-point mounting scheme can be utilized to mount the pump of each pump module thereto, in order to accommodate flexure of the pump module structure The pumping unit can include any number of pumps. For example, as noted above, in embodiments, the pumping unit can include two pumps. Alternatively, in embodiments, a pumping unit can include a single pump module. In embodiments, one or more of the pump modules have included packing grease systems (e.g., with no fluid connections to base structure). In embodiments, one or more of the pump modules are connected with a remote packing grease system (e.g., a centralized packing grease service). In embodiments, the pump module(s) can include pump life tracking system (s) for component identification, data processing, data storage and/or communications (e.g., internal and/or external).

Figure 1B:
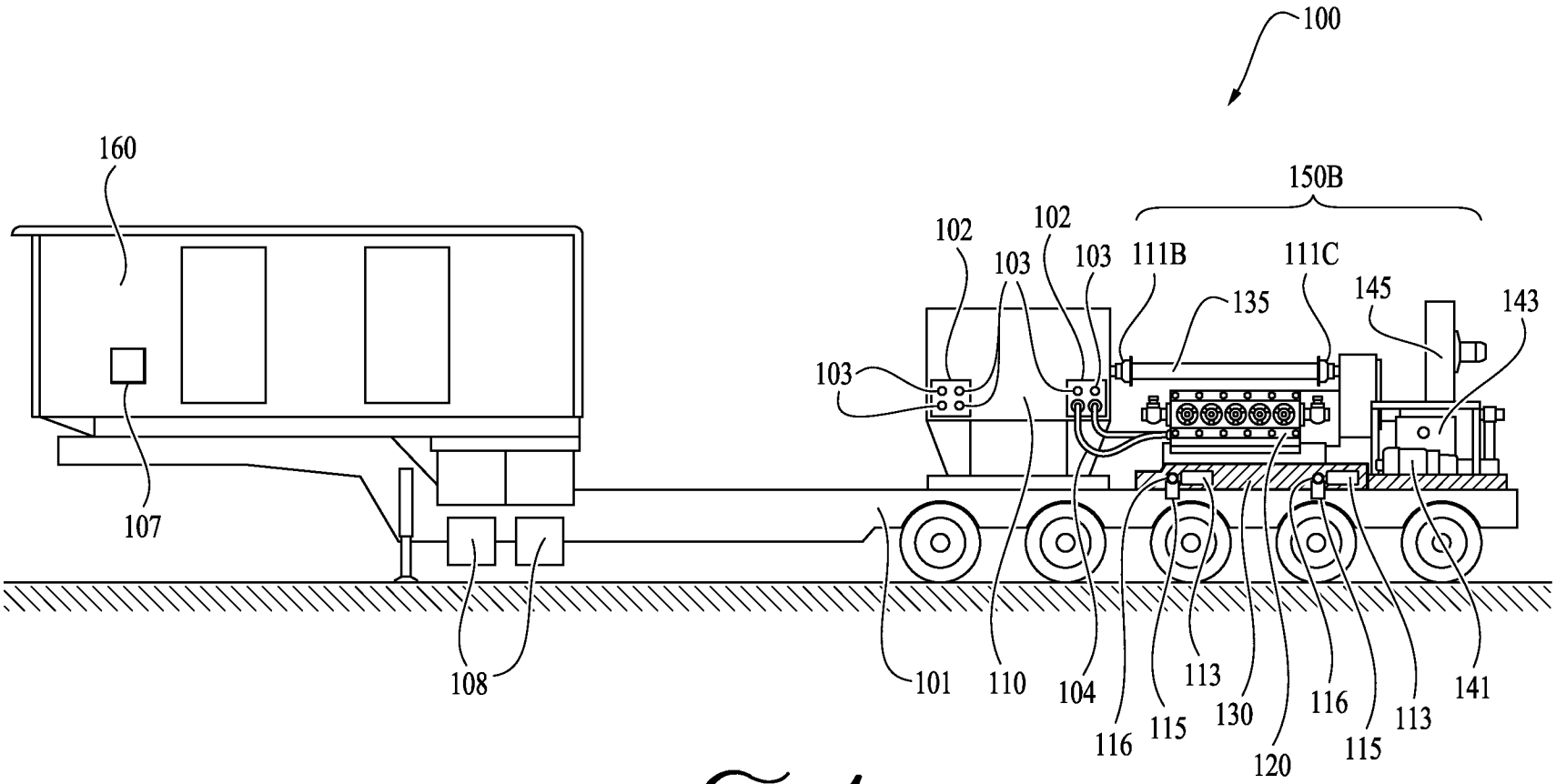
FIG. 1B is a schematic of the modularized, electric pumping unit of FIG. 1A with one pump module removed.
Figure 1C:
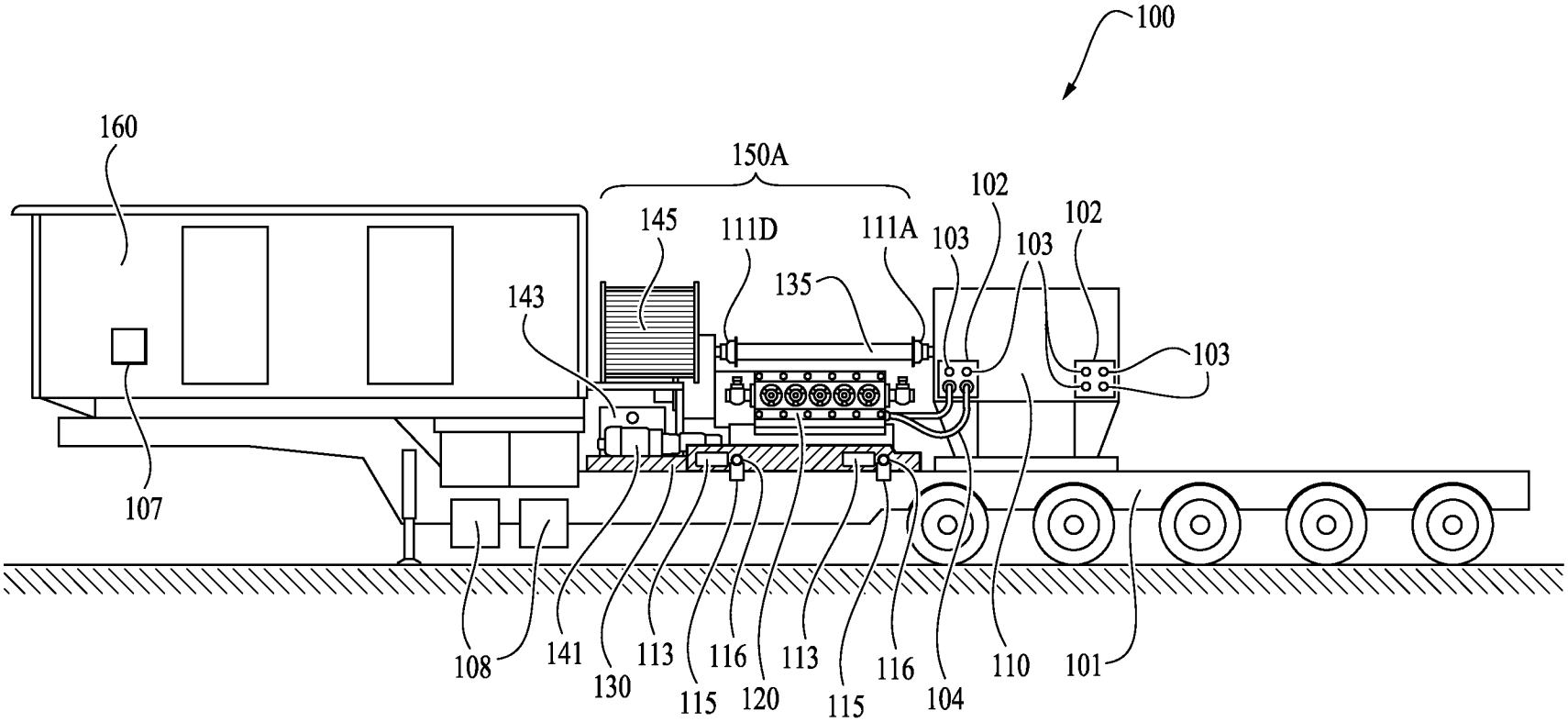
FIG. 1C is a schematic of the modularized, electric pumping unit of FIG. 1A with another pump module removed.
Figure 1D:
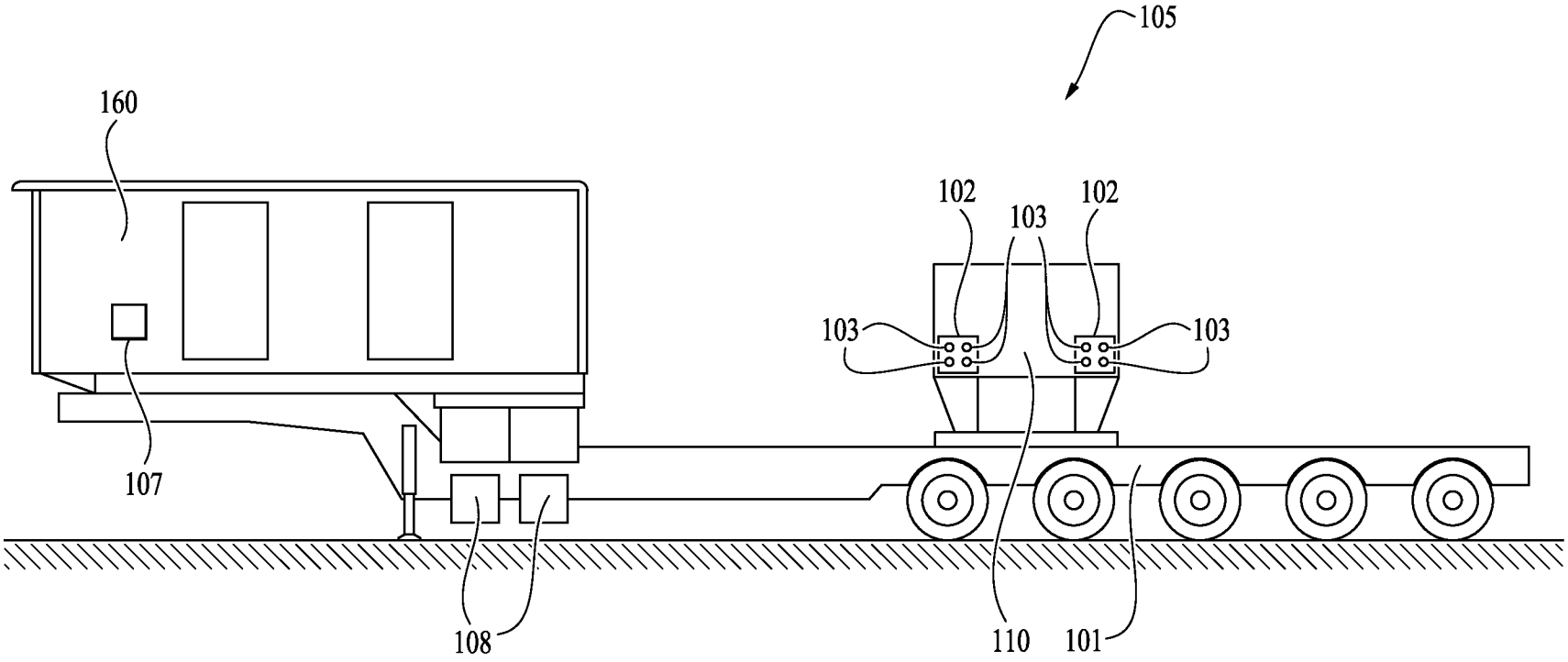
FIG. 1D is a schematic of a base structure assembly of the modularized, electric pumping unit of FIG. 1A.

Having broadly described the pumping unit of this disclosure, a more detailed description will now be provided with reference to FIG. 1A, which is a schematic of a modularized, electric pumping unit 100, according to embodiments of this disclosure, comprising two pump modules 150, including first pump module 150A and second pump module 150B; FIG. 1B, which is a schematic of the modularized, electric pumping unit 100 of FIG. 1A with one pump module 150A removed; FIG. 1C, which is a schematic of the modularized, electric pumping unit of FIG. 1A with the other pump module 150B removed; FIG. 1D, which is a schematic of a base structure assembly 105; and FIGS. 2A-3B, which are schematic views of a pump module 150, according to embodiments of this disclosure.

As depicted in FIGS. 1A-1C, a modularized, electric pumping unit 100 (referred to herein simply as a "pumping unit 100") of this disclosure can comprise a base structure 101; an electric motor 110 mounted on the base structure 101; and one or more pump modules 150. As depicted via brackets, in the embodiment of FIG. 1A, the one or more pump modules 150 include two pump modules 150, comprising first pump module 150A and second pump module 150B. Each of the one or more pump modules 150 comprises a pump 120 and a pump module structure 130. The one or more pump modules 150 are configured to be removably mounted on the base structure 101 and driven by the electric motor 110.

The pumping unit 100 can further comprise at least one connector panel 102 comprising connectors 103 for electrical cables and/or hoses 104 from the one or more pump modules 150, wherein the electrical cables and/or hoses 104 are configured for supplying fluids, electric power, and/or control signals to the one or more pump modules 150, and/or to receive sensor feedback from the one or more pump modules 150. One or more of the connectors/receptacles 103 can be configured for providing/receiving electrical power to the connector panel 102.

The base structure 101 can comprise a truck, a trailer, or a skid. As best seen in FIG. 1D, which is a schematic of a base structure assembly 105, the pumping unit 100 can include a base structure assembly 105 comprising the base structure 101, the electric motor 110, an electric motor drive 160 (which can include) an auxiliary electric power supply 107, or a combination thereof mounted on the base structure 101. A pump packing lubrication system 108 can be mounted on the base structure 101.

The base structure can further comprise one or more mounting points/elements 115, and each of the one or more pump modules 150 can comprise one or more complementary mounting points/elements 116, configured such that each of the one or more mounting points 115 of the base structure 101 are configured to receive/align with one or more of the one or more complementary mounting elements 116 of the one or more pump modules 150, to position and/or align the pump module 150 (e.g., a driveline 135 thereof) with the electric motor 110 (e.g., with a motor shaft 111 thereof).

As more clearly depicted in FIGS. 2A-3B, each of the one or more pump modules 150 can comprise the pump module structure 130, the pump 120, a driveline 135, and pump auxiliary systems 140. The pump auxiliary systems 140 can comprise an oil lubrication pump 141, an oil reservoir 143, one or more oil filters 144, an oil cooler 145, an oil heater 187, a sensor package 146 (e.g., comprising one or more sensors 147 for monitoring pressure, temperature, position), a driveline 135 ("driveshaft assembly"), or a combination thereof. The an oil lubrication pump 141 can be powered by an auxiliary electric motor 142, in embodiments. Oil cooler 145 can comprise a heat exchanger 145' (e.g., radiator having oil circulating therein) and a fan 145", in embodiments. The oil heater 187 can comprise a heat exchanger or heating element such as an electrical resistance heating element 188 disposed within the oil reservoir 143 or a heating jacket disposed around all or a portion of the oil reservoir 143. The oil cooler and/or heater can be controlled by control systems 153 responsive to temperature of the oil and/or ambient temperature sensed by one or more sensors of the sensor package 146. The pump auxiliary systems 140 can further comprise a suction manifold 148 and a discharge manifold 149 (FIG. 2C) with connectors for piping, a pump packing lubrication system 151 (FIG. 2C), a driveshaft clutch and/or driveshaft decoupler 152, electrical cables and/or hoses 104, control systems 153, or a combination thereof.

Figure 4A:
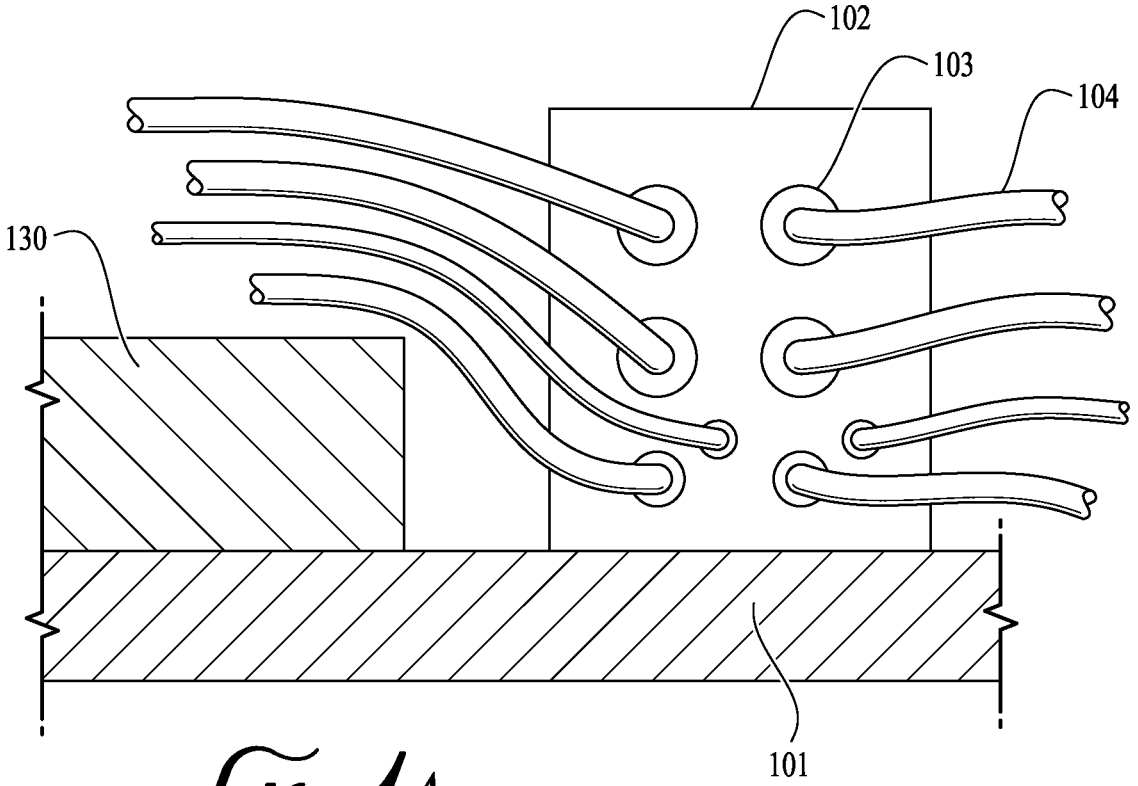
FIG. 4A is a close-up view of a portion of a pumping unit comprising a connectors panel, according to embodiments of this disclosure.

Each of the pump modules 150 can comprise cables and/or hoses 104 that extend to one or more connector panels 102 mounted on the base structure 101. For example, two connector panels 102 are depicted in the embodiments of FIGS. 1A-1C. However, in embodiments, a single connector panel 102 can be utilized for one, two, or more pump modules 150, or a plurality of connector panels 102 can be associated with each pump module 150. As best depicted in FIG. 4A, which is a close-up view of a portion of a pumping unit 100 comprising connectors panel 102, according to embodiments of this disclosure connector panel 102 is mounted on base structure 101 (rather than on pump module structure 130). One or more cables (e.g., electrical cables) and/or hoses 104 can connect the connector panel 102 with (e.g., components of) pump module 150. A receptacle/connector 103 of the connector panel 102 can receive electrical supply for the pumping unit 100.

Each of the one or more pump modules 150 can further comprise one or more lift components 113 configured for removal of each of the one or more pump modules 150 from the base structure 101. The lifting components 113 are not particularly limited, and can comprise, for example, one or more forklift pockets, lifting eyes, or a combination thereof.

Figure 2A:
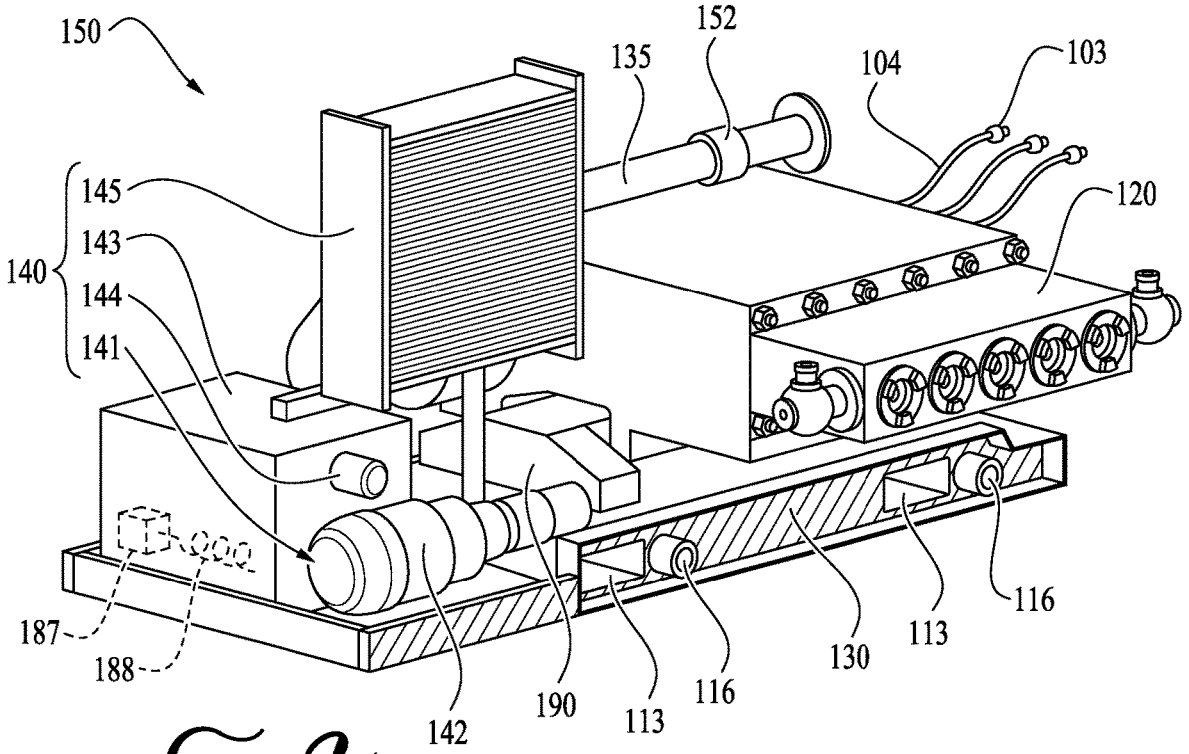
FIG. 2A is a schematic of a pump module, according to embodiments of this disclosure.
Figure 2B:
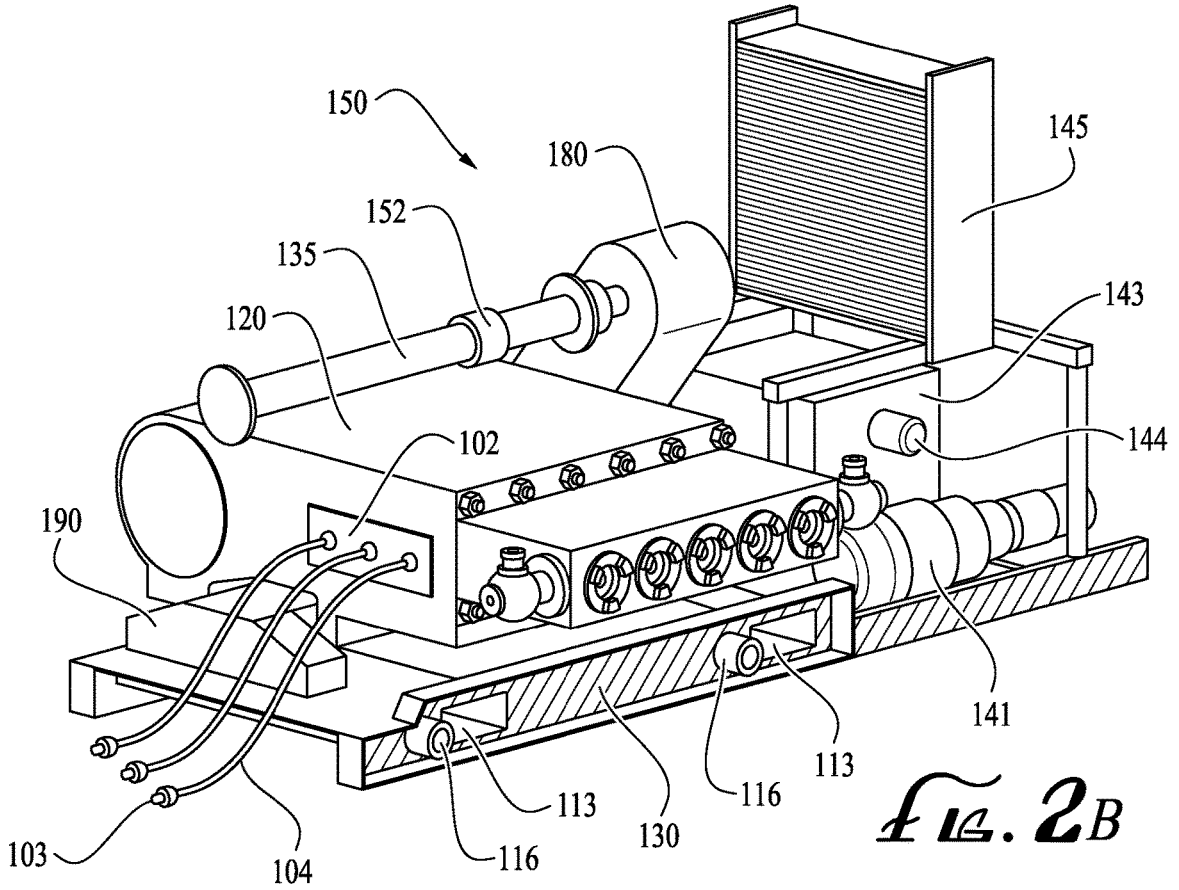
FIG. 2B is a schematic of a pump module, according to embodiments of this disclosure.
Figure 2C:
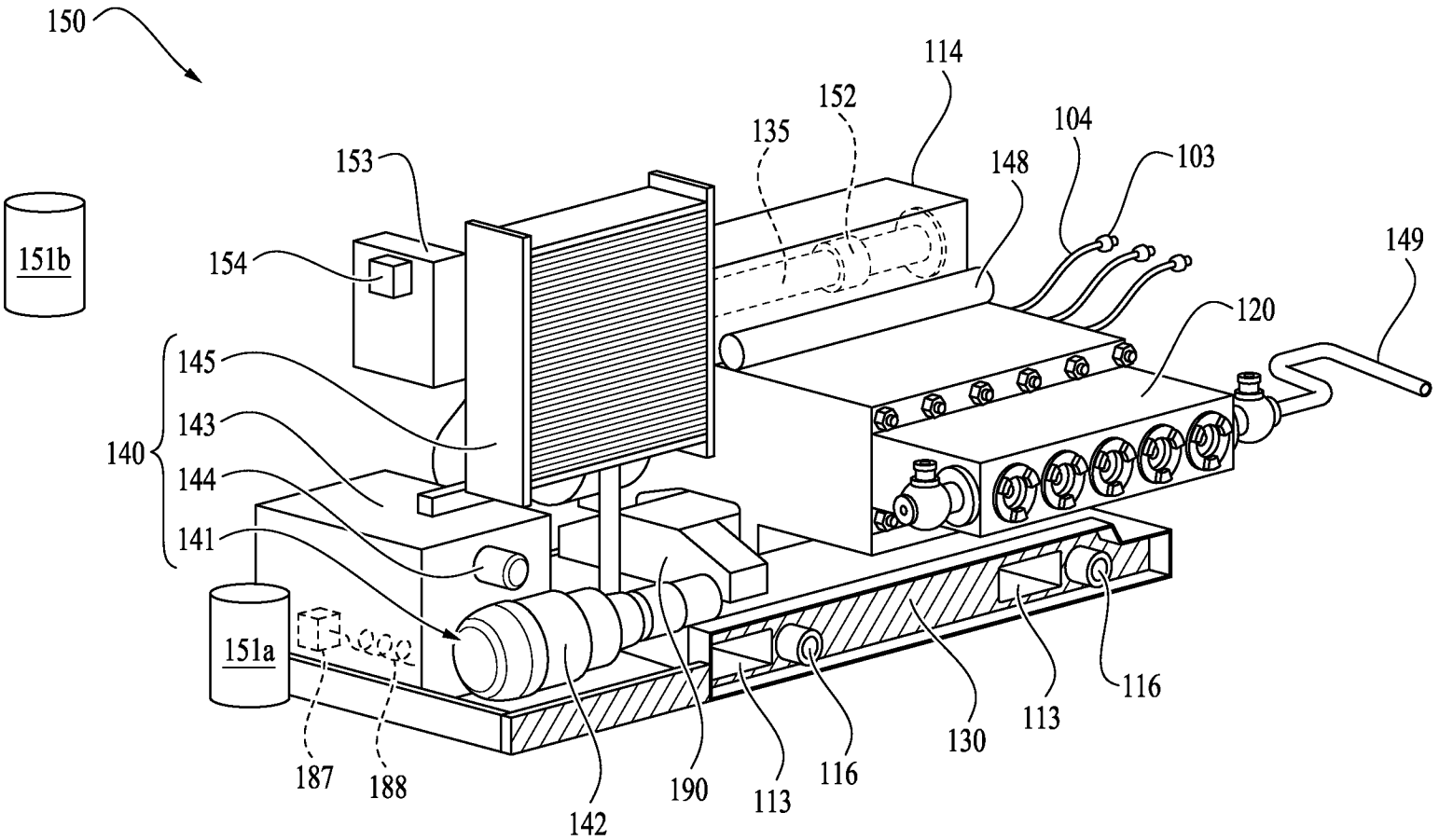
FIG. 2C is a schematic of a pump module, according to embodiments of this disclosure.

As depicted in FIG. 2B and FIG. 2C, each of the one or more pump modules 150 can further comprise guarding 114, such as configured for rotating or otherwise moving one or more components of the pump module 150; deflectors, trays, and/or tanks 117, such as for directing or containing fluids; or a combination thereof.

The electric motor 110 can comprise a first drive shaft 111A and a second drive shaft 111B. In such embodiments, as depicted in FIGS. 1A-1C, the pumping unit 100 can comprise two pump modules 150, with a first pump module 150A and a second pump module 150B depicted in FIG. 1A. First pump module 150A is connected to the first drive shaft 111A and second pump module 150B is connected to the second drive shaft 111B, whereby the two pump modules 150 can be driven by the single electric motor 110. As depicted in FIG. 1B and FIG. 1C, one pump module 150 (e.g., pump module 150A in FIG. 1B and pump module 150B in FIG. 1C) can be removed from pumping unit 100.

As noted hereinabove, the pumping unit 100 can be designed to operate with a single pump module 150 or more pump modules 150 (e.g., with exactly two pump modules 150). In embodiments, a pump module designed for operation with one pump module 150 can also be operated with a single pump module 150.

As depicted in FIG. 2C, each of the one or more pump modules 150 can further comprise a pump packing lubrication system 151*a* (e.g., a "packing grease system"), and/or can be connected to a remote pump packing grease system 151*b*, and have no fluid connections from the pump packing lubrication system 151 to the base structure 101.

One or more of the pump module(s) 150 can comprise a pump life monitoring system 154 that is operable to provide component identification, data processing, data storage and/or communications (e.g., internal and/or external), or a combination thereof. In this manner, life data for each pump module 150 can be monitored and tracked (e.g., independently of the life of a pumping unit 100 itself).

As noted herein, pump 120 of each pump module 150 can comprise a triplex or quintuplex plunger pump (e.g., positive displacement pump), in embodiments. Pump 120 of each of the one or more pump modules 150 can be mounted onto the pump module structure 130 of the each of the one or more pump modules 150 in a manner designed to reduce and/or prevent translation of flexure of the pump module structure 130 to the pump 120. For example, in embodiments, pump 120 of each of the one or more pump modules 150 can be mounted onto the pump module structure 130 of the each of the one or more pump modules 150 via a three-point mounting sub-structure 190 that reduces and/or prevents translation of flexure of the pump module structure 130 to the pump 120.

Additionally, or alternatively, pump 120 of one or more pump modules 150 can be a centrifugal pump. A centrifugal pump for pumping wellbore servicing fluids downhole comprises a housing having an inlet and an outlet, and a rotating impeller disposed within the housing. The impeller has a plurality of vanes extending radially outwardly from a central hub and is mounted on a shaft that is driven by the electric motor. The impeller rotates at high speed, creating a centrifugal force that propels the wellbore servicing fluid (e.g., fracturing fluid) through the pump and into the wellbore via a manifold and associate piping fluidically coupling the pump 120 to the wellbore.

Each of the one or more pump modules 150 is driven by the electric motor 110 via connection of a driveline 135 of each of the pump modules 150 with a shaft 111 of the electric motor 110. In embodiments, the driveline can comprise a driveshaft clutch and/or a driveshaft decoupler 152, whereby rotary motion can be prevented from being transmitted from the electric motor 110 to pump 120. Such a driveshaft clutch and/or a driveshaft decoupler 152 is disclosed, for example, in U.S. patent application Ser. No. 18/150,478, the disclosure of which is hereby incorporated herein in its entirety for purposes not contrary to this disclosure.

Figure 2D:
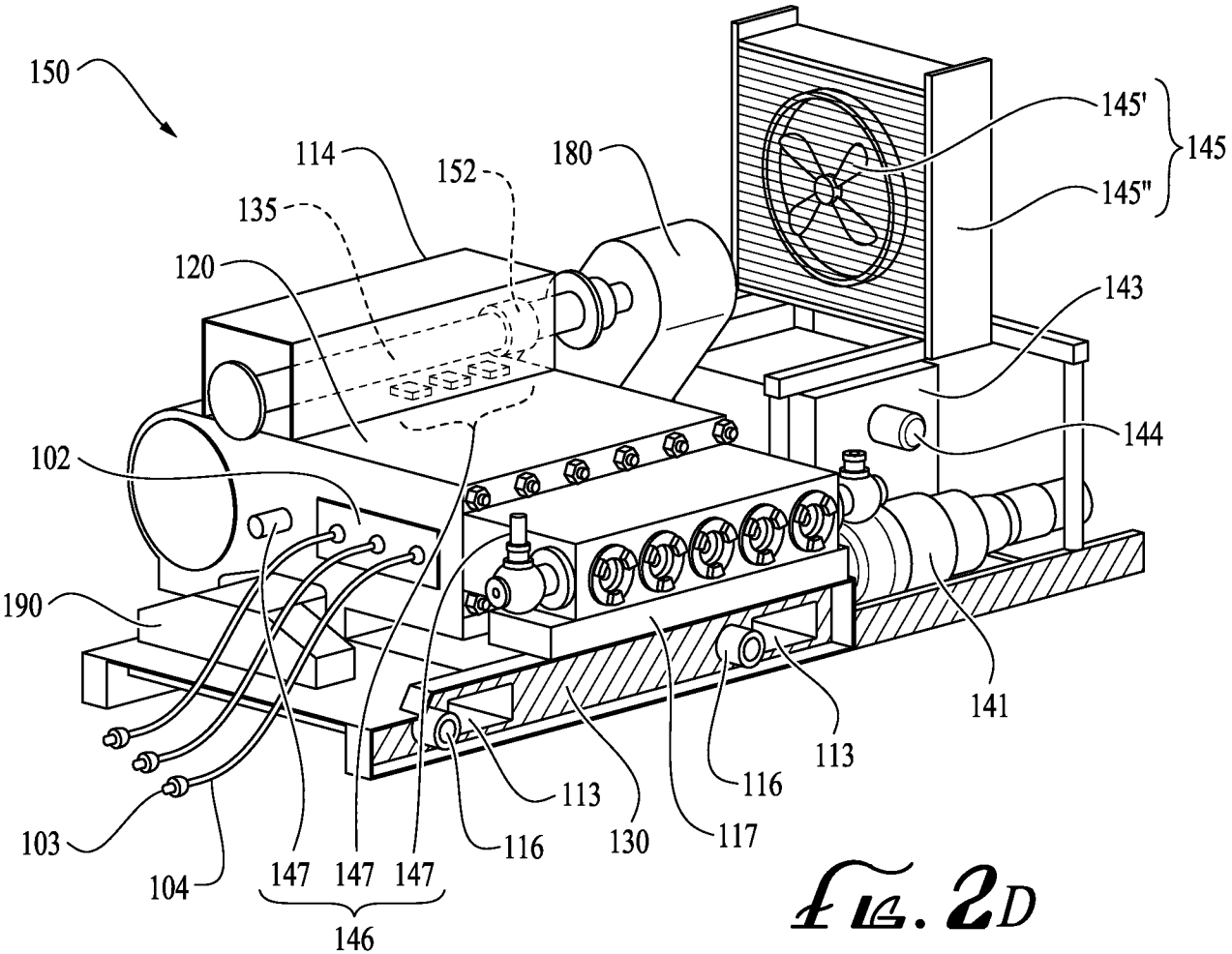
FIG. 2D is a schematic of a pump module, according to embodiments of this disclosure.
Figure 3A:
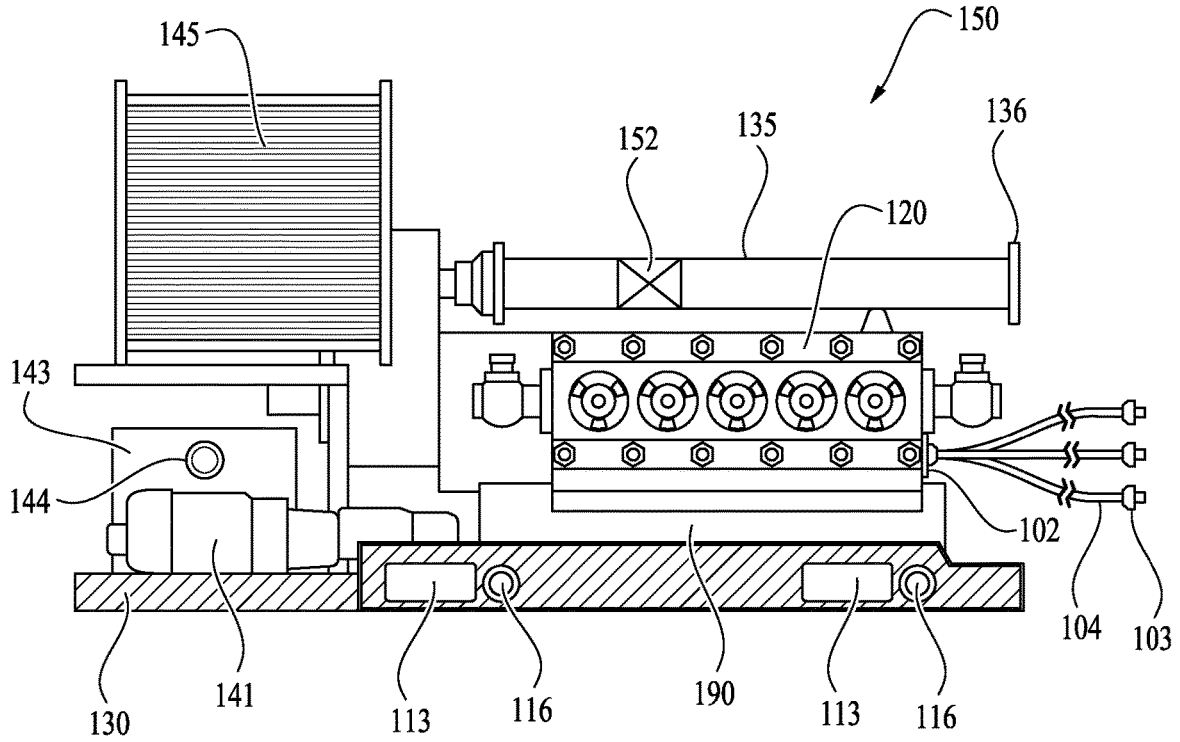
FIG. 3A is a schematic of a pump module, according to embodiments of this disclosure.
Figure 3B:
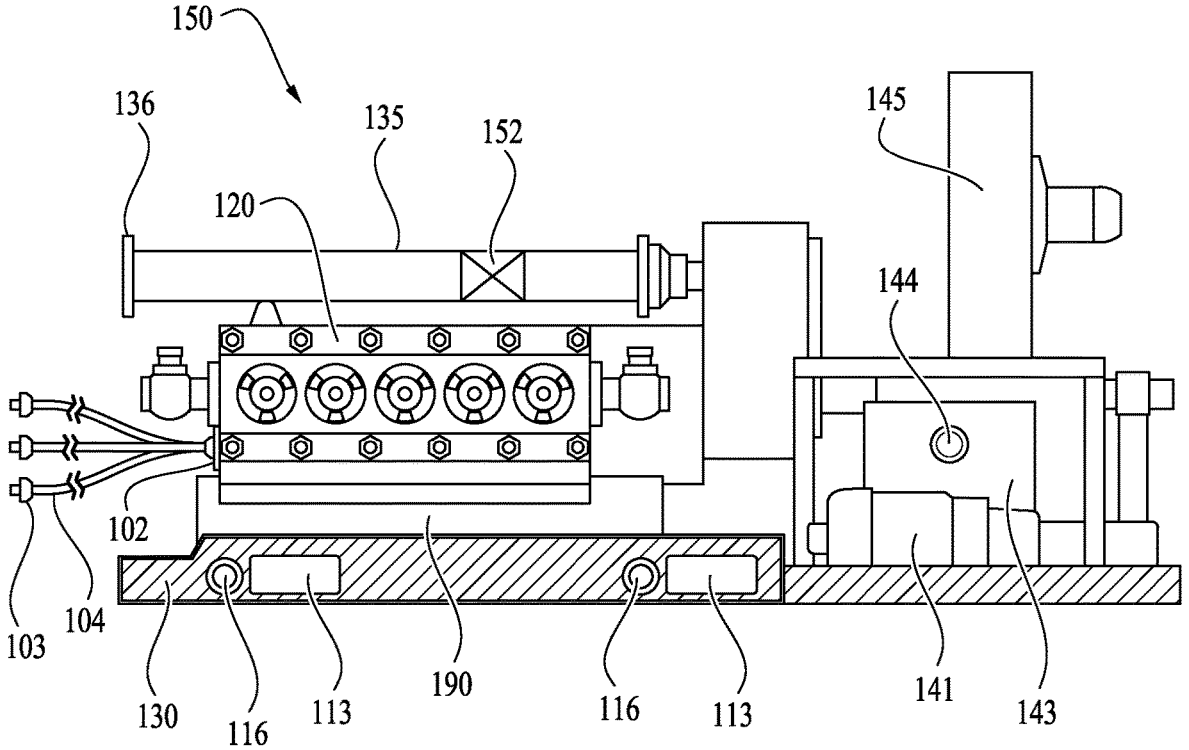
FIG. 3B is a schematic of a pump module, according to embodiments of this disclosure.
Figure 4B:
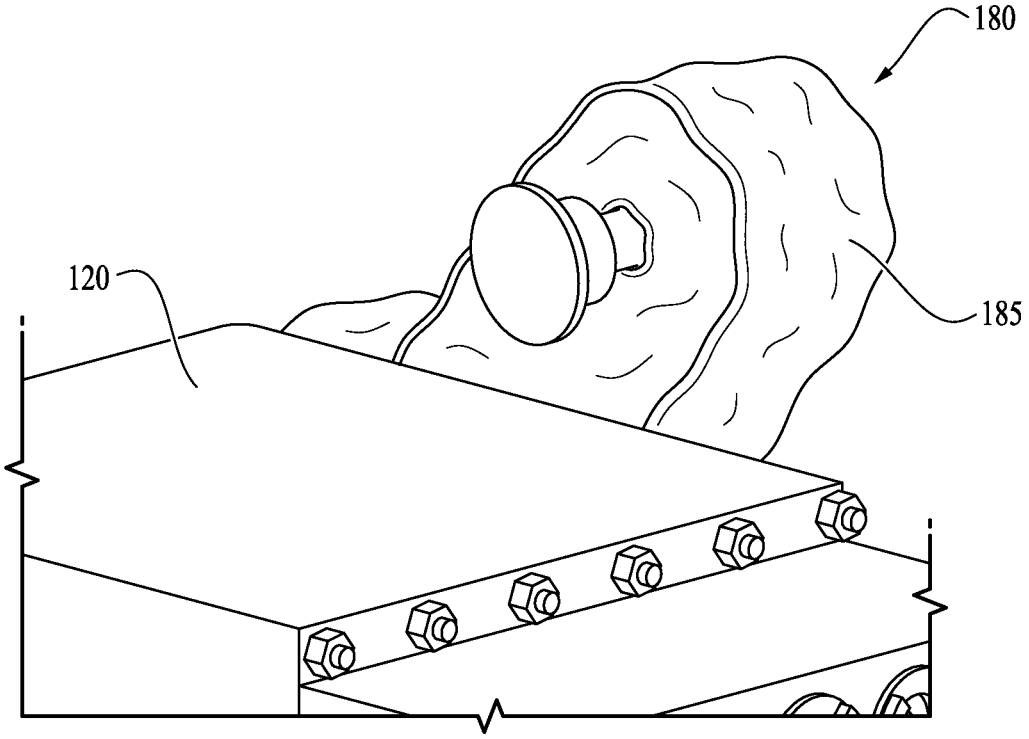
FIG. 4B is a close-up of another portion of a pumping unit comprising a sound blanket over a gear box/speed reducer, according to embodiments of this disclosure.

As best seen in FIG. 2B and FIG. 2D, the pumping unit 100 can further comprise a gear box/speed reducer 180 positioned on or near the pump 120 (e.g., operatively connected with a driveline 135 of the pump 120 of each of the one or more pump modules 150), and configured to reduce input speed to electric motor 110. With reference to FIG. 4B, which is a close-up of another portion of a pumping unit 100 comprising gear box/speed reducer 180, in embodiments, the pump module 150 further comprises a sound blanket 185 on the gear box/speed reducer 180, to reduce noise emanation therefrom.

Also disclosed herein is a method comprising: transporting a modularized, electric pumping unit 100, of this disclosure. The pumping unit 100 can be a pumping unit 100 as described herein. For example, the pumping unit 100 can comprise: a base structure assembly 105 comprising: a base structure 101, an electric motor 110, an electric motor drive 160, an auxiliary electric power supply 107, or a combination thereof mounted to the base structure 101; and one or more pump modules 150, wherein each of the one or more pump modules 150 is configured for mounting on the base structure 101 and connection to the electric motor 110, whereby a pump 110 of each of the one or more pump modules 150 can be driven by the electric motor 110, and wherein all of the one or more pump modules 150 are not mounted on the base structure 101 during the transporting of the pumping unit 100 (e.g., one or more of the pump modules 150 are removed from the base structure 101 prior to transport).

The method can further comprise assembling the (modularized, electric) pumping unit 100 after the transporting. Assembling can comprise mounting the one or more pump modules 150 on the base structure 101 and operatively connecting each of the one or more pump modules 150 to the electric motor 110.

Operatively connecting can further comprise, for each of the one or more pump modules 150: engaging one or more lifting components 113 of the each pump module 150 with a lifting apparatus 112 (e.g., a forklift) and positioning the each pump module 150 on the base structure 101 such that one or more of the mounting elements 115 of the base structure 101 engage/align with the one or more complementary mounting elements 116 of the each pump module 150, thus affixing a pump module structure 130 of the each pump module 150 to the base structure 101; and connecting one or more electrical cables and/or hoses 104 of the each pump module 150 to connectors 103 of a connector panel 102 on the base structure 101 of the pumping unit 150; and connecting a driveline 135 of the each pump module 150 to the electric motor 110.

The method can further include removing one or more of the pump modules 150 (to a dis-assembled configuration of the pumping unit 100, for example as depicted in FIG. 1B-FIG. 1D) from an assembled configuration (e.g., FIG. 1A) of the pumping unit 100 prior to the transporting. Removing the one or more pump modules 150 from the assembled configuration of the pumping unit 100 can further comprise, for each of the one or more pump modules 150: disconnecting a driveline 135 of the each pump module 150 from the electric motor 110; unplugging electrical cables and/or hoses 104 from connectors 103 on the base structure 101; releasing complementary mounting elements 116 affixing a pump module structure 130 of the each pump module 150 to the base structure 101; and lifting the each pump module 150 off the base structure 101.

Figure 5:
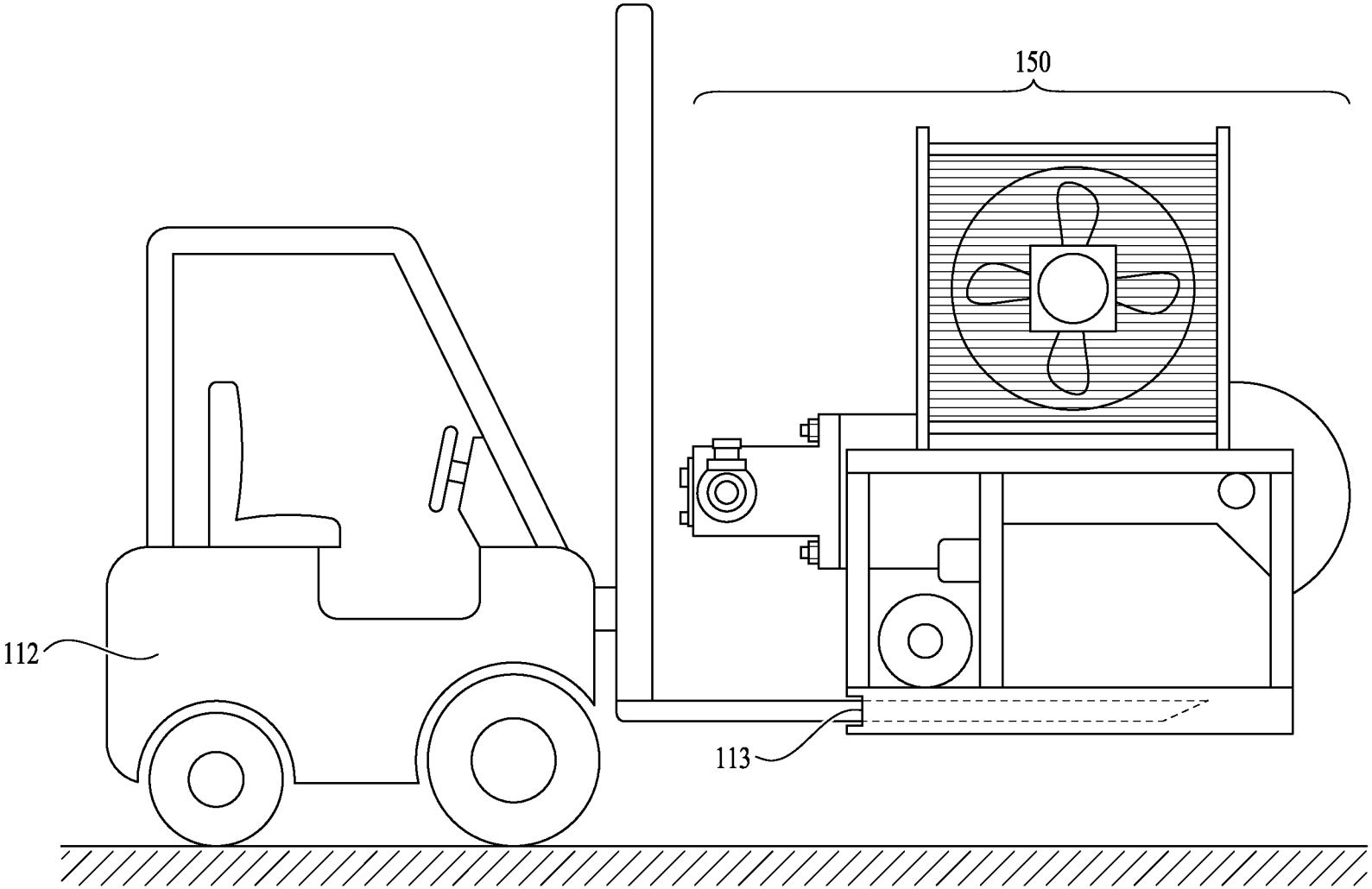
FIG. 5 is a schematic of a pump module according to embodiments of this disclosure being transported.

Lifting the each pump module 150 off the base structure 101 can comprise engaging one or more lifting components/points 113 on the pump module structure 130 of the each pump module 150 with a lifting apparatus 112, and utilizing the lifting apparatus 112 to lift the each pump module 150 off the base structure 101. As depicted in FIG. 5, which is a schematic of a pump module 150 according to embodiments of this disclosure being transported, the lifting apparatus 112 can comprise a forklift, and the lifting components/points 113 can comprise one or more forklift pockets 113, whereby the forklift 112 can engage the forklift pockets to lift the pump module 150 off the base structure 101.

Also disclosed herein are a method of servicing a wellbore and a wellbore servicing system 200 comprising one or more pumping units 100 of this disclosure. An embodiment of a wellbore servicing system 200 and a method of servicing a wellbore via the wellbore servicing system 200 will now be described with reference to FIG. 6, which is a schematic representation of an embodiment of a wellbore servicing system 200, according to embodiments of this disclosure. For simplicity and clarity, components of pumping units 100 and pump modules 150 other than pumps 120 and electric motors 110 have been omitted from FIG. 6.

A method of servicing a wellbore 224 according to this disclosure can comprise fluidly coupling a pump 120 of a pump module 150 of a pumping unit 100 of this disclosure, as described hereinabove, to a source of a wellbore servicing fluid (e.g., a wellbore services manifold trailer 204) and to the wellbore 224, and communicating wellbore servicing fluid into the wellbore 224 via the pump 120. The pump 120 can comprise a pump fluid end and a pump power end. The pump power end is operable to reciprocate a reciprocating element within a reciprocating element bore of the pump fluid end.

The method of servicing the wellbore can comprise connecting a fluid inlet (e.g., suction or suction manifold 148) on each of the one or more pump modules 150 to a source of a wellbore servicing fluid (e.g., a wellbore services manifold trailer 204), connecting a fluid outlet (e.g., outlet or discharge manifold 149) on each of the one or more pump modules 150 to a well, and operating each of the one or more pump modules 150 via the electric motor 110 to pump the wellbore servicing fluid (e.g., fracturing fluid) into the wellbore 224 and surrounding formation (e.g., to fracture the subterranean formation). The method can further comprise recovering oil and/or gas (e.g., hydrocarbons) from the wellbore 224 (e.g., flowing to the wellbore via the fractured subterranean formation).

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, diverter fluids, sealants, drilling fluids, completion fluids, gelation fluids, polymeric fluids, aqueous fluids, oleaginous fluids, etc.

In embodiments, the wellbore servicing system 200 comprises one or more pumping units 100 operable to perform oilfield and/or well servicing operations. The oilfield and/or well servicing operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 10 disclosed herein may be employed in any suitable operation. Each of the one or more pumping units 100 comprises one or a plurality of pump modules 150, and each of the one or more pump modules 150 comprises one or a plurality of pumps 120 operated by an electric motor 110, as detailed hereinabove.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

Figure 6:
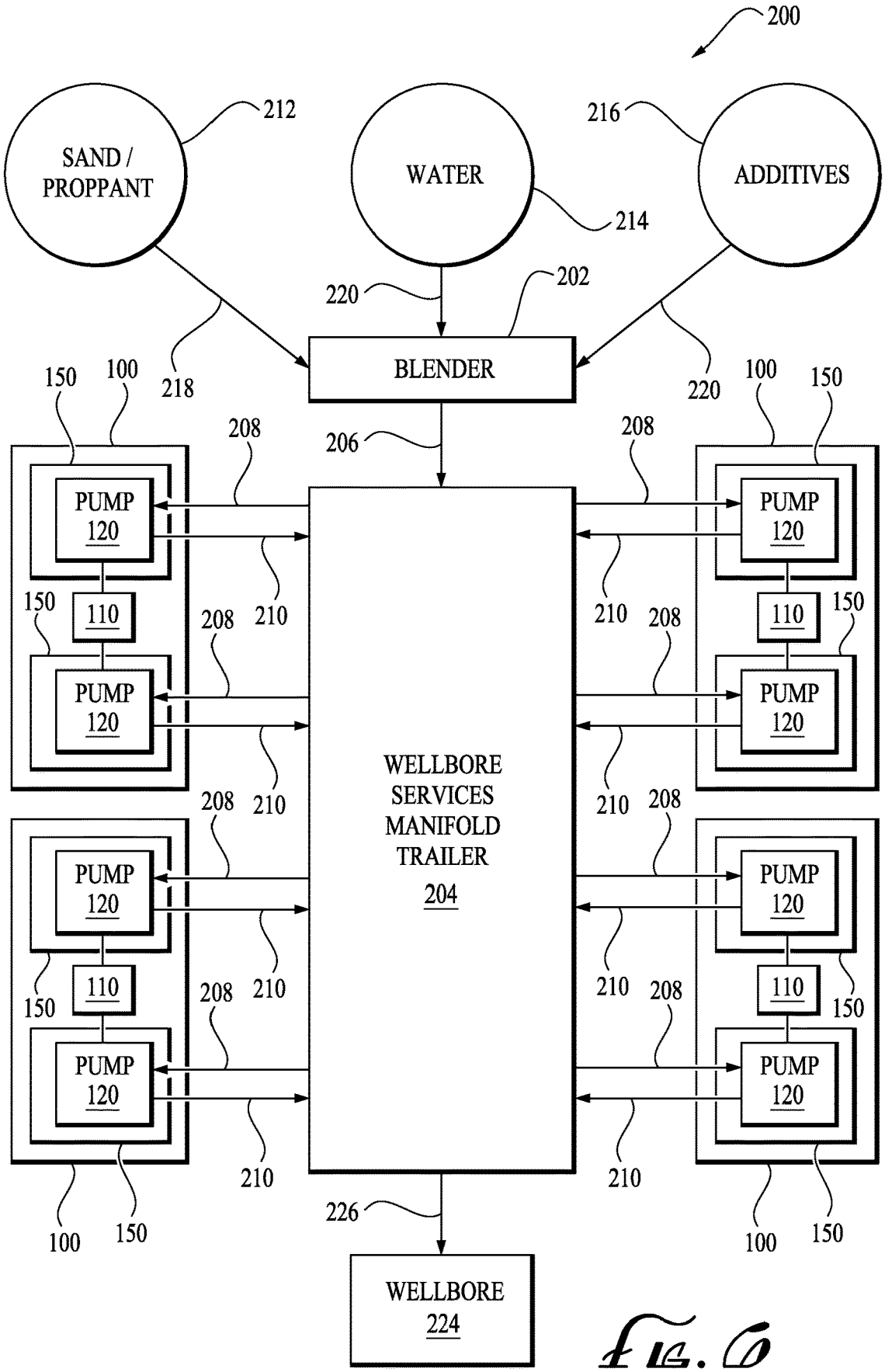
FIG. 6, which is a schematic representation of an embodiment of a wellbore servicing system, according to embodiments of this disclosure.

For example, the wellbore servicing system 200 of the embodiment of FIG. 6 comprises a blender 202 that is coupled to a wellbore services manifold trailer 204 via flowline 206. As used herein, the term "wellbore services manifold trailer" can include a truck, trailer, and/or other wellbore servicing fluid source comprising one or more manifolds for receiving, organizing, and/or distributing wellbore servicing fluids during wellbore servicing operations. In the embodiment of FIG. 6, the wellbore services manifold trailer 204 is coupled to eight positive displacement pumps 120 via outlet flowlines 208 (e.g., connected to suction manifolds 148 of pump module(s) 150) and inlet flowlines 210 (e.g., connected to discharge flow lines 149 of pump modules 150). In alternative embodiments, however, there may be more or less pumps used in a wellbore servicing operation. Outlet flowlines 208 are outlet lines from the wellbore services manifold trailer 204 that supply fluid to the pumps 120. Inlet flowlines 210 are inlet lines from the pumps 120 that supply fluid to the wellbore services manifold trailer 204. One or more (e.g., two adjacent) pumps 120 can be mounted on a module 150. One or more modules 150 can be positioned on a base structure 101 of a pumping unit 100. The pumps 120 and pump modules can be mounted to a base structure 101 (e.g., a trailer) for transportation to the wellsite via, for example, a semi-tractor, or the pump modules 150 and the base structure assembly 105 can be transported separately, as described hereinabove.

The blender 202 can be utilized/operable to mix or otherwise combine solid and fluid components of the wellbore servicing fluid to achieve a well-blended wellbore servicing fluid. As depicted, in embodiments, sand or proppant 212, water 214, and/or additives 216 can be fed into the blender 202 via feedlines 218, 220, and 212, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 120 pressurize the wellbore servicing fluid to a pressure suitable for delivery into a wellbore 224 or wellhead. For example, the pumps 120 can increase the pressure of the wellbore servicing fluid to a pressure of greater than or equal to about 3,000 psi, 5,000 psi, 10,000 psi, 20,000 psi, 30,000 psi, 40,000 psi, or 50,000 psi, or higher, in embodiments.

From the pumps 120, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. In embodiments, pumps 120 discharge wellbore servicing fluid at a fluid flow rate of between about 1 BPM to about 200 BPM, alternatively from between about 50 BPM to about 150 BPM, alternatively about 100 BPM. In embodiments, the pumps 120 discharge wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

The pump modules 150 and pumping units 100 of this disclosure can provide a number of potential features and advantages, which will be apparent to those of skill in the art upon reading this disclosure. For example, via this disclosure a pump (e.g., pump 120) and related auxiliary equipment (e.g., pump auxiliary systems 140 and etc., as described hereinabove and depicted in the Figures) can be mounted on a frame (e.g., pump module structure 130) that is removable from the main unit base structure (e.g., base structure 101). In one embodiment, two pump modules 150 can be mounted on a trailer (e.g., when base structure 101 comprises a trailer) and driven by a single electric motor (e.g., electric motor 110). The motor (e.g., motor 110) and its drive (e.g., variable frequency electric drive 160), as well as connection points (e.g., connector panel 102) for the pump module 150 electric cables and fluid hoses 104, can remain on the base structure (e.g., base structure 101). Via this disclosure, the electrically-driven modular pump system can be mounted on a base structure 101 that has connection points (e.g., connectors 103 on connector panel 102) for related cables and/or hoses 104.

In embodiments, the pumping unit 100 of this disclosure can facilitate transportation of high-power-density electric fracturing units from one location to another, can reduce capital requirement per spread, and/or can improve maintenance efficiency and effectiveness. The herein disclosed pumping unit 100 can provide for electric fracturing service with near- or fully-self-contained auxiliary systems.

The pumping units 100 of this disclosure can comprise electric drive (e.g., electric drive 160 and electric motor 110). The pumping units 100 of this disclosure do not include electrical or fluid couplers mounted to the module/section frame (e.g., to the pump module structure 130); rather, via this disclosure, such electrical or fluid couplers (e.g. connector panel 102 and/or connectors 103) are mounted (e.g., directly) to base structure 101.

ADDITIONAL DISCLOSURE

The following are non-limiting, specific embodiments in accordance with the present disclosure:

In a first embodiment a (modularized, electric) pumping unit 100 comprises: a base structure 101; an electric motor 110 mounted on the base structure 101; and one or more pump modules 150, each of the one or more pump modules comprising a pump 120 and a pump module structure 130, wherein the one or more pump modules 150 are configured to be removably mounted on the base structure 101 and driven by the electric motor 110.

A second embodiment can include the pumping unit of the first embodiment further comprising at least one connector panel 102 affixed to the base structure 101 and comprising connectors 103 for electrical cables and/or hoses 104 from the one or more pump modules 150, wherein the electrical cables and/or hoses 104 are configured for supplying fluids, electric power, and/or control signals to the one or more pump modules 150, and/or to receive sensor feedback from the one or more pump modules 150.

A third embodiment can include the pumping unit of the first or the second embodiment, wherein the base structure 101 comprises a truck, a trailer, or a skid.

A fourth embodiment can include the pumping unit of any one of the first to third embodiments, comprising a base structure assembly 105 comprising the base structure 101, the electric motor 110, an electric motor drive, an auxiliary electric power supply 107, or a combination thereof (e.g., mounted on the base structure 101).

A fifth embodiment can include the pumping unit of any one of the first to fourth embodiments, further comprising a pump packing lubrication system 108 mounted on the base structure 101.

A sixth embodiment can include the pumping unit of any one of the first to fifth embodiments, wherein the base structure 101 further comprises one or more mounting points 115, and wherein each of the one or more pump modules 150 comprises one or more complementary mounting elements 116, wherein each of the one or more mounting points 115 of the base structure 101 are configured to receive/align with one or more of the one or more complementary mounting elements 116 of the one or more pump modules 150, to position and/or align the pump module 150 (e.g., a driveline 135 thereof) with the electric motor 110 (e.g., with a motor shaft 111 thereof).

A seventh embodiment can include the pumping unit of any one of the first to sixth embodiments, wherein each of the one or more pump modules 150 comprises the pump module structure 130, the pump 120, a driveline 135, and pump auxiliary systems 140.

An eighth embodiment can include the pumping unit of the seventh embodiment, wherein the pump auxiliary systems 140 further comprise an oil lubrication pump 141, (e.g., powered by an auxiliary electric motor 142), an oil reservoir 143, one or more oil filters 144, and oil cooler 145 (e.g., comprising a heat exchanger 145' and a fan 145"), a sensor package 146 (e.g., comprising one or more sensors 147 for monitoring pressure, temperature, position, or the like), a driveline 135 ("driveshaft assembly"), or a combination thereof.

A ninth embodiment can include the pumping unit of any one of the first to eighth embodiments, wherein the pump auxiliary systems 140 further comprise a suction manifold 148 and a discharge manifold 149 with connectors for piping, a pump packing lubrication system 151, a driveshaft clutch and/or driveshaft decoupler 152, electrical cables 104, control systems 153, or a combination thereof.

A tenth embodiment can include the pumping unit of any one of the first to ninth embodiments, wherein each of the pump modules 150 comprises cables and/or hoses 104 that extend to one or more connector panels 102 mounted on the base structure 101.

An eleventh embodiment can include the pumping unit of any one of the first to ninth embodiments, wherein each of the one or more pump modules 150 further comprises lift components 113 configured for removal of each of the one or more pump modules 150 from the base structure 101.

A twelfth embodiment can include the pumping unit of the eleventh embodiment, wherein the lifting components 113 comprise forklift pockets, lifting eyes, or a combination thereof.

A thirteenth embodiment can include the pumping unit of any one of the first to twelfth embodiments, wherein each of the one or more pump modules 150 further comprises guarding 114 configured for rotating or otherwise moving one or more components of the pump module 150, deflectors, trays, and/or tanks 117 for directing or containing fluids, or a combination thereof.

A fourteenth embodiment can include the pumping unit of any one of the first to thirteenth embodiments, wherein the electric motor 110 comprises a first drive shaft 111A and a second drive shaft 111B (e.g., extending horizontally in opposite directions from the electric motor), and wherein the pumping unit 100 comprises two pump modules 150, a first pump module 150A connected to the first drive shaft 111A and a second pump module 150B connected to the second drive shaft 111B, whereby the two pump modules 150 are driven by the electric motor 110.

A fifteenth embodiment can include the pumping unit of any one of the first to fourteenth embodiments, comprising a single pump module 150 or comprising exactly two pump modules 150.

A sixteenth embodiment can include the pumping unit of any one of the first to fifteenth embodiments, wherein each of the one or more pump modules 150 further comprises a pump packing lubrication system 151 (e.g., a "packing grease system"), and/or are connected to a remote pump packing grease system 151, and no fluid connections of the pump packing lubrication system are mounted to the base structure 101.

A seventeenth embodiment can include the pumping unit of any one of the first to sixteenth embodiments, wherein one or more of the one or more pump modules 150 comprise a pump life monitoring system 154 that includes component identification, data processing, data storage and communications (e.g., internal and/or external), or a combination thereof.

An eighteenth embodiment can include the pumping unit of any one of the first to seventeenth embodiments, wherein each of the one or more pump modules 150 comprises a triplex or quintuplex plunger pump.

A nineteenth embodiment can include the pumping unit of any one of the first to eighteenth embodiments, wherein the pump 120 of each of the one or more pump modules 150 is mounted onto the pump module structure 130 of the each of the one or more pump modules 150 via a three-point mounting sub-structure 190 that reduces and/or prevents translation of flexure of the pump module structure 130 to the pump 120.

A twentieth embodiment can include the pumping unit of any one of the first to nineteenth embodiments, wherein each of the one or more pump modules 150 is driven by the electric motor 110 via connection of a driveline 135 of each of the pump modules 150 with a shaft 111 of the electric motor 110, and wherein the driveline 135 comprises a driveshaft clutch and/or a driveshaft decoupler 152.

A twenty first embodiment can include the pumping unit of any one of the first to twentieth embodiments, further comprising a gear box/speed reducer 180 positioned on or near the pump (e.g., operatively connected with a driveline 135 of the pump of each of the one or more pump modules 150), and configured to reduce an input speed to the electric motor 110.

A twenty second embodiment can include the pumping unit of any one of the first to twenty first embodiments, further comprising a sound blanket 185 on the gear box/speed reducer 180.

In a twenty third embodiment, a method comprises: transporting a (modularized, electric) pumping unit 100, wherein the pumping unit 100 comprises: a base structure assembly 105 comprising: a base structure 101, and an electric motor 110, an electric motor drive 106, an auxiliary electric power supply 107, or a combination thereof mounted to/supported by the base structure 101; and one or more pump modules 150, wherein each of the one or more pump modules 150 is configured for mounting on the base structure 101 and connection to the electric motor 110, whereby a pump 110 of each of the one or more pump modules 150 can be driven by the electric motor 110, and wherein the one or more pump modules 150 are not mounted on the base structure 101 during the transporting of the pumping unit 100.

A twenty fourth embodiment can include the method of the twenty third embodiment, further comprising assembling the (modularized, electric) pumping unit 100 after the transporting (e.g., at a jobsite such as a wellsite or well pad), wherein assembling comprises mounting the one or more pump modules 150 on the base structure 101 and operatively connecting each of the one or more pump modules 150 to the electric motor 110.

A twenty fifth embodiment can include the method of the twenty fourth embodiment, wherein operatively connecting further comprises, for each of the one or more pump modules 150: engaging one or more lifting components 113 of the each pump module 150 with a lifting apparatus 112 (e.g., a forklift) and positioning the each pump module 150 on the base structure 101 such that one or more of the mounting elements 115 of the base structure 101 engage/align with the one or more complementary mounting elements 116 of the each pump module 150, thus affixing a pump module structure 130 of the each pump module 150 to the base structure 101; and connecting one or more electrical cables and/or hoses 104 of the each pump module 150 to connectors 103 of a connector panel 102 on the base structure 101 of the pumping unit 150; and connecting a driveline 135 of the each pump module 150 to the electric motor 110.

A twenty sixth embodiment can include the method of any one of the twenty third to the twenty fifth embodiments, further comprising removing one or more of the pump modules 150 from an assembled configuration of the pumping unit 100 prior to the transporting.

A twenty seventh embodiment can include the method of the twenty sixth embodiment, wherein removing the one or more pump modules 150 from the assembled configuration of the pumping unit 100 further comprises, for each of the one or more pump modules 150: disconnecting a driveline 135 of the each pump module 150 from the electric motor 110; unplugging electrical cables and/or hoses 104 from connectors 103 on the base structure 101; releasing complementary mounting elements 116 affixing a pump module structure 130 of the each pump module 150 to the base structure 101; and lifting the each pump module 150 off the base structure 101.

A twenty eighth embodiment can include the method of the twenty seventh embodiment, wherein lifting the each pump module 150 off the base structure 101 comprises engaging one or more lifting components/points 113 on the pump module structure 130 of the each pump module 150 with a lifting apparatus 112 (e.g., a forklift), and utilizing the lifting apparatus 112 to lift the each pump module 150 off the base structure 101.

In a twenty ninth embodiment, a pump module 150 comprises a pump 120 affixed to a pump module structure 130, a driveline 135 operatively connected to the pump 120, and pump auxiliary systems 140, wherein the pump module 150 is configured to be removably mounted on a base structure 101 of a pumping unit 100 and driven by an electric motor affixed to the base structure 101.

A thirtieth embodiment can include the pump module 150 of the twenty ninth embodiment, wherein the pump auxiliary systems 140 further comprise an oil lubrication pump 141, (e.g., powered by an auxiliary electric motor 142), an oil reservoir 143, one or more oil filters 144, and oil cooler 145 (e.g., comprising a heat exchanger 145' and a fan 145"), a sensor package 146 (e.g., comprising one or more sensors 147 for monitoring pressure, temperature, position), a driveline 135, or a combination thereof.

A thirty first embodiment can include the pump module 150 of the twenty ninth or thirtieth embodiment, wherein the base structure further comprises at least one connector panel 102 affixed to the base structure and comprising connectors 103 for electrical cables and/or hoses 104 from the pump module 150, wherein the electrical cables and/or hoses 104 are configured for supplying fluids, electric power, and/or control signals to the pump module, and/or to receive sensor feedback from the pump module, and wherein the pump module does not comprise such a connector panel thereon.

A thirty second embodiment can include the pump module 150 of any one of the twenty ninth to thirty first embodiments, wherein the pump 120 of the pump module 150 is mounted onto the pump module structure 130 via a three-point mounting sub-structure 190 that reduces and/or prevents translation of flexure of the pump module structure 130 to the pump 120.

A thirty third embodiment can include the pump module 150 of any one of the twenty ninth to thirty second embodiments, further comprise a pump life monitoring system 154 that includes component identification, data processing, data storage and/or communications (e.g., internal and/or external), or a combination thereof.

A thirty fourth embodiment can include the pump module 150 of any one of the twenty ninth to thirty third embodiments, further comprising a gear box/speed reducer 180 positioned on or near the pump (e.g., operatively connected with a driveline 135 of the pump), and configured to reduce input speed to the electric motor 110, when the pump module 150 is operatively connected with the electric motor 110, and the electric motor 110 is in operation.

A thirty fifth embodiment can include the pump module 150 of the thirty fourth embodiment, further comprising a sound blanket 185 on the gear box/speed reducer 180.

A thirty sixth embodiment can include the method of any of twenty fourth or twenty fifth embodiments, further comprising connecting a fluid inlet on each of the one or more pump modules to a source of a wellbore servicing fluid, connecting a fluid outlet on each of the one or more pump modules to a well penetrating a subterranean formation, and operating each of the one or more pump modules via the electric motor to pump the wellbore servicing fluid (e.g., fracturing fluid) into the well and surrounding formation (e.g., to fracture the subterranean formation), and optionally further comprising recovering oil and/or gas (e.g., hydrocarbons) from the well (e.g., flowing to the well via the fractured subterranean formation).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. A pumping unit comprising:
a base structure;
an electric motor mounted on the base structure; and
one or more pump modules, each of the one or more pump modules comprising a pump, a gear box coupled to the pump, a driveline coupled to the gear box, and a pump module structure,
wherein the gear box is positioned on or near an end of the pump opposite the electric motor,
wherein the driveline is positioned above the pump, and, during operation, mechanically connects the electric motor with the gear box, and
wherein the one or more pump modules are configured to be removably mounted on the base structure and the pump driven by the electric motor.

2. The pumping unit of claim 1, further comprising at least one connector panel affixed to the base structure and comprising connectors for electrical cables, hoses, or both from the one or more pump modules, wherein the electrical cables are configured for supplying electric power to the one or more pump modules, for communicating control signals to the one or more pump modules, for communicating sensor feedback from the one or more pump modules, or combinations thereof and wherein the hoses are configured for supplying fluids to the one or more pump modules.

3. The pumping unit of claim 1, wherein the base structure further comprises one or more mounting points, and wherein each of the one or more pump modules comprises one or more complementary mounting elements, wherein each of the one or more mounting points of the base structure are configured to receive and align with one or more of the one or more complementary mounting elements of the one or more pump modules, to position and align the pump module with the electric motor.

4. The pumping unit of claim 1, wherein each of the pump modules comprises cables, hoses, or both that extend to one or more connector panels mounted on the base structure.

5. The pumping unit of claim 1, wherein each of the one or more pump modules further comprises lift components configured for removal of each of the one or more pump modules from the base structure.

6. The pumping unit of claim 1, wherein the pumping unit comprises two pump modules, a first pump module comprising a first driveline and a first pump and a second pump module comprising a second driveline and a second pump, whereby the first pump and the second pump are, during operation, both driven by the electric motor via the first driveline and the second driveline, respectively.

7. The pumping unit of claim 1, wherein one or more of the one or more pump modules comprise a pump life monitoring system that includes component identification, data processing, data storage, data communications, or a combination thereof.

8. The pumping unit of claim 1, wherein the pump of each of the one or more pump modules is mounted onto the pump module structure of the each of the one or more pump modules via a three-point mounting sub-structure that reduces or prevents translation of flexure of the pump module structure to the pump.

9. A method comprising:

transporting a pumping unit, wherein the pumping unit comprises:

a base structure assembly comprising: a base structure, an electric motor, an electric motor drive, an auxiliary electric power supply, or a combination thereof mounted to the base structure; and one or more pump modules, each of the one or more pump modules comprising a pump, a gear box coupled to the pump, a driveline coupled to the gear box, and a pump module structure, wherein the gear box is positioned on or near end of the pump opposite the electric motor, wherein the driveline is positioned above the pump and, during operation, mechanically connects the electric motor with the gear box, wherein each of the one or more pump modules is configured for mounting on the base structure and connection to the electric motor via the driveline, whereby a pump of each of the one or more pump modules can be driven by the electric motor, wherein the one or more pump modules are not mounted on the base structure during the transporting of the pumping unit.

10. The method of claim 9, further comprising assembling the pumping unit after the transporting to provide an assembled pumping unit, wherein assembling comprises mounting the one or more pump modules on the base structure and operatively connecting each of the one or more pump modules to the electric motor.

11. The method of claim 10, wherein operatively connecting further comprises, for each of the one or more pump modules:

engaging one or more lifting components of the each pump module with a lifting apparatus and positioning the each pump module on the base structure such that one or more of the mounting elements of the base structure engage and align with the one or more complementary mounting elements of the each pump module, thus affixing a pump module structure of the each pump module to the base structure; and connecting one or more electrical cables, hoses, or both of the each pump module to connectors of a connector panel on the base structure of the pumping unit; and connecting the driveline of the each pump module to the electric motor.

12. The method of claim 10, further comprising connecting a fluid inlet on each of the one or more pump modules to a source of a wellbore servicing fluid, connecting a fluid outlet on each of the one or more pump modules to a well, and operating each of the one or more pump modules via the electric motor to pump the wellbore servicing fluid into the well.

13. The method of claim 9, further comprising removing one or more of the pump modules from an assembled configuration of the pumping unit prior to the transporting.

14. The method of claim 13, wherein removing the one or more pump modules from the assembled configuration of the pumping unit further comprises, for each of the one or more pump modules:

disconnecting the driveline of the each pump module from the electric motor;

unplugging electrical cables, hoses, or both from connectors on the base structure;

releasing complementary mounting elements affixing a pump module structure of the each pump module to the base structure; and lifting the each pump module off the base structure.

15. The method of claim 14, wherein lifting the each pump module off the base structure comprises engaging one or more lifting components on the pump module structure of the each pump module with a lifting apparatus, and utilizing the lifting apparatus to lift the each pump module off the base structure.

16. A pump module comprising a pump affixed to a pump module structure, a driveline operatively connected to the pump via a gear box, wherein the gear box is positioned on or near end of the pump opposite an electric motor during operation, wherein the driveline is positioned above the pump, and, during operation, mechanically connects the electric motor with the gear box, and wherein the pump module is configured to be removably mounted on a base structure of a pumping unit and the pump thereof driven by the electric motor affixed to the base structure.

17. The pump module of claim 16, wherein the base structure further comprises at least one connector panel affixed to the base structure and comprising connectors for electrical cables, hoses, or both from the pump module, wherein the electrical cables are configured for supplying electric power to the one or more pump modules, for communicating control signals to the one or more pump modules, for communicating sensor feedback from the one or more pump modules, or combinations thereof;

wherein the hoses are configured for supplying fluids to the one or more pump modules; and wherein the pump module does not comprise such a connector panel thereon.

18. The pump module of claim 16, wherein the pump of the pump module is mounted onto the pump module structure via a three-point mounting sub-structure that reduces or prevents translation of flexure of the pump module structure to the pump.

19. The pump module of claim 16, further comprising a pump life monitoring system that includes component identification, data processing, data storage, data communications, or a combination thereof.

20. The pump module of claim 16, further comprising an oil lubrication pump, an oil reservoir, one or more oil filters, and oil cooler.

21. The pump module of claim 20, further comprising a pump packing lubrication system having no fluid connections to the base structure; and a suction manifold and a discharge manifold with connectors for piping.

22. The pump module of claim 16, further comprising a pump packing lubrication system having no fluid connections to the base structure.

* * * * *